US006621997B2

(12) United States Patent
Chung

(10) Patent No.: US 6,621,997 B2
(45) Date of Patent: Sep. 16, 2003

(54) MULTI-FUNCTION ACTUATOR OF DUPLEX PRINTER

(75) Inventor: Kyung-shig Chung, Suwon (KR)

(73) Assignee: Samsung Electronic Co., Ltd., Suwon (KR)

( * ) Notice: Subject to any disclaimer, the term of this patent is extended or adjusted under 35 U.S.C. 154(b) by 0 days.

(21) Appl. No.: 10/198,142

(22) Filed: Jul. 19, 2002

(65) Prior Publication Data

US 2003/0108359 A1 Jun. 12, 2003

(30) Foreign Application Priority Data

Dec. 6, 2001 (KR) ..... 2001-76986

(51) Int. Cl.[7] ..... G03G 15/00; G03G 15/20
(52) U.S. Cl. ..... 399/122; 399/124; 399/401
(58) Field of Search ..... 399/122, 124, 399/401, 21, 328, 333

(56) References Cited

U.S. PATENT DOCUMENTS 4,384,781 A * 5/1983 Takada ..... 399/122
5,680,651 A * 10/1997 Tsuji et al. ..... 399/401
5,950,050 A * 9/1999 Shirasaki et al. ..... 399/124
5,956,547 A * 9/1999 Kamei et al. ..... 399/122

* cited by examiner

*Primary Examiner*—Joan Pendegrass
(74) *Attorney, Agent, or Firm*—Staas & Halsey LLP

(57) ABSTRACT

A multi-function actuator of a duplex printer selects one of movement passages of a printing medium according to whether to print one side or on both sides of the printing medium and includes a duplex guide, a jam removing mechanism, a sensor arm, and a sensor. The duplex guide is rotatable disposed above a pressure roller of a duplex printer frame and includes a hollow cylinder and a plurality of bar-shaped guide pins at one side thereof guiding the printing medium. The jam removing mechanism is rotatable disposed inside of the hollow cylinder to allow the pressure roller to be separated from the heat roller when a jammed material is removed. The with arm is disposed co-axially with the duplex guide and rotates by a weight thereof. The sensor is disposed at the duplex printer frame and operates by the sensor arm. Accordingly, the multi-function actuator selects the one of the movement passage and allows the jammed material to be removed by separating the pressure roller from the heat roller.

49 Claims, 7 Drawing Sheets

MULTI-FUNCTION ACTUATOR OF DUPLEX PRINTER

CROSS-REFERENCE TO RELATED APPLICATIONS

This application claims the benefit of Korean Patent Application No. 2001-76986 filed on Dec. 6, 2001, in the Korean Industrial Property Office, the disclosure of which is incorporated herein by reference.

BACKGROUND OF THE INVENTION

1. Field of the Invention

The present invention relates to a duplex printer, and more particularly, to a duplex printer having a multi-function actuator selecting a movement passage of a printing medium according to one side or both sides of the printing medium and removing a jammed printing medium disposed in the movement passage.

2. Description of the Related Art

Generally, a duplex printer can print an image on one side or both sides of a printing medium according to a user selection.

FIG. 1 shows a cross-sectional view of the duplex printer having a conventional actuator. The duplex printer includes a simplex printing passage 10 and a duplex printing passage 20.

The simplex printing passage 10 includes a development unit 11 developing a given image on a printing medium 1 fed by a feeding roller 3, a fixing unit 14 including a pressure roller 12 and a heat roller 13 fixing the developed image on the printing medium 1, a simplex transporting roller 16 transporting a printed printing medium 1 from the fixing unit 14, and a discharge roller 5 discharging the printed printing medium 1 to a discharge tray 7.

A duplex printing passage 20 includes a plurality of duplex transporting rollers 21,22,23 transporting the printing medium 1, which has been printed on the one side thereof and is transported from the discharge roller 5 to the feeding roller 3.

Also, an actuator 30 has one end 31 being hinged at a duplex printer frame and is disposed among the discharge roller 5, the simplex transporting roller 16, and the duplex transporting roller 21. Therefore, the simplex printing passage 10 or the duplex printing passage 20 can be selected by moving the actuator 30.

In the duplex printer, an operation of printing one side or both sides of the printing medium 1 is described as follows.

When printing on one side of the printing medium 1, the printing medium 1 passes through the fixing unit 14 and is transported to the discharge roller 5 by the simplex transporting roller 16 and then discharged in a discharging direction to the discharge tray 7 by the discharge roller 5. At this time, the printing medium 1, which passes through the simplex transporting roller 16, is freely moved into the discharge roller 5 because the actuator 30 is positioned at a first position P1.

Also, when printing on both sides of the printing medium 1, first, the printing medium 1, which has been printed on the one side thereof through the operation described above, is moved into the discharge roller 5. And then the discharge roller 5 is rotated in a reverse direction before the printing medium 1 moves away from the discharge roller 5 so that the printing medium 1 is moved in an opposite direction. At this time, because the actuator 30 is located at a second position P2, the printing medium 1, moved in the direction opposite to the discharging direction, can be moved into the duplex printing passage 20. And then the printing medium 1 printed on the one side thereof is transported to the development unit 11 by the duplex transporting rollers 21, 22, 23 and the feeding roller 3. Here, the other side of the printing medium 1 is turned to face upward by the duplex transporting rollers 21, 22, 23 and the feeding roller 3. Then the printing medium 1 printed on the one side thereof is printed on the other side by the development unit 11 and the fixing unit 14 and discharged to the discharge tray 7 by the discharge roller 5. Accordingly, the printing medium 1 can be printed on both sides thereof by the actuator 30.

FIG. 2 shows a cross-sectional view of another type of duplex printer having another conventional actuator. The actuator 40 is rotatable disposed above the pressure roller 62 and includes a body 41, a duplex guide 43, a sensor arm 45, and an actuator separator 47 independently projecting in a predetermined direction from the body 41. Also, the duplex guide 43, the sensor arm 45, and the actuator separator 47 are integrally formed with the body 41.

The body 41 has a cylindrical shape, and both ends thereof are rotatable disposed at an upper part of a frame where a pressure roller 62 is disposed.

The duplex guide 43 projects from the body 41, is disposed above a heat roller 63, and rotates upward by an interference with a front end of the printing medium 1 passing through the fixing unit 64.

The sensor arm 45 projects from a vicinity of one end of the body 41 in an upward direction relative to the duplex guide 43 at an angle of approximately 120° with respect to the duplex guide 43. When the duplex guide 43 is in a horizontal position, an upper part of the sensor arm 45 is detected by using a sensor 49 mounted on the duplex printer frame.

The actuator separator 47 projects from a vicinity of an opposite end of the body 41 in the upward direction relative to the duplex guide 43 at an angle of approximately 90°. The actuator separator 47 is used for manually rotating the duplex guide 43 by a predetermined angle to remove a jammed printing medium 1. Accordingly, the jammed printing medium 1 to be removed from the fixing unit 64 is not blocked by the duplex guide 43 during removal of the jammed printing medium 1.

In the duplex printer having the actuator 40 constructed as above, a duplex printing operation is performed as follows.

The printing medium 1 passes through the fixing unit 64 with the one side printed, the duplex guide 43 rotates by the front end of the printing medium 1 by a predetermined angle, and the printing medium 1 is moved into the discharge passage 50.

After a trailing end of the printing medium 1 moves into the discharge passage 50 and does not contact the duplex guide 43, the discharge roller 53 is rotated in the reverse direction so that the printing medium 1 is moved in the opposite direction. At this time, because the duplex guide 43, which rotates downward to the horizontal position by a weight thereof, blocks above the fixing unit 64 and the printing passage 60, the printing medium 1 moves in the opposite direction into the duplex printing passage 70.

The printing medium 1 moved into the duplex printing passage 70 moves into the development unit 61 by a transfer roller 71 again, and then is printed on a non-printed side. Then the printing medium 1 printed on both sides thereof is discharged to the discharge tray 80 by the discharge rollers 51,53. Accordingly, the printing medium 1 can be printed on both sides thereof by the operation of the actuator 40.

However, in the duplex printer constructed as shown in FIG. 1, there is a problem that the jammed printing medium 1 cannot be removed by the actuator 30 when the jammed printing medium 1 is jammed in the fixing unit 14. Therefore, a separate additional apparatus removing the jammed printing medium 1 is needed.

Also, in the duplex printer constructed as shown in FIG. 2, there is another problem that the jammed printing medium 1 is blocked by the duplex guide 43 when the jammed printing medium 1 is removed from the fixing unit 64 or the discharge passage 50.

There is another problem that the separate additional apparatus separating the pressure roller 62 and the heat roller 63 of the fixing unit 64 requires a free space in which the separate additional apparatus is disposed.

SUMMARY OF THE INVENTION

Therefore, it is an object of the present invention to provide a multi-function actuator having an actuator separating a pressure roller from a heat roller by an actuator separator so that a jammed printing medium is easily removed from a fixing unit.

Another object of the present invention is to provide a multi-function actuator, in which a duplex guide is disposed apart from a movement passage of a printing medium so that a jammed printing medium is easily removed from a discharge passage.

Additional objects and advantages of the invention will be set forth in part in the description which follows and, in part, will be obvious from the description, or may be learned by practice of the invention.

To achieve the above and other objects, a multi-function actuator according to an embodiment of the present invention includes a duplex guide rotatable disposed above a pressure roller of a duplex printer frame. The duplex guide includes a hollow cylinder and a plurality of bar-shaped guide pins formed at one side of the hollow cylinder and arranged in a row above a heat roller to guide a printing medium. The duplex guide is rotated by the printing medium by a guide angle in a printing medium feeding direction from a first position blocking a printing passage of the printing medium to a second position opening the printing passage. The multi-function actuator includes a jam removing mechanism rotatable disposed inside of the hollow cylinder to allow the pressure roller to be separated from the heat roller when a jammed printing medium is removed, a sensor arm disposed co-axially with the duplex guide to rotate by a weight of the sensor arm and having a low part supported by a supporting end of the duplex guide to form a first predetermined angle between the sensor arm and the guide pins, and a sensor disposed at the duplex printer frame to sense the sensor arm when the duplex guide is rotated by the printing medium.

Further, the jam removing mechanism includes a jam removing lever rotatable disposed at the duplex printer frame and on a side of the pressure roller and having a penetrating hole disposed at a middle part thereof, into which a rotation shaft of the pressure roller is inserted, a jam removing shaft inserted inside of the hollow cylinder and rotatable disposed at the duplex printer frame, an actuator separator attached on one side of the jam removing shaft to rotate the jam removing shaft by a second predetermined angle in the printing medium feeding direction to allow the printing medium jammed between the pressure roller and the heat roller to be removed, and a jam removing cam disposed on another side of the jam removing shaft to contact an upper portion of the jam removing lever and formed such that if the actuator separator rotates at the second predetermined angle, the jam removing lever is rotated by the jam removing cam by a third predetermined angle in the same printing medium feeding direction to separate the pressure roller from the heat roller.

Further, the actuator separator includes a rib rotating the duplex guide when the jammed printing medium is removed.

Further, the duplex guide is rotated at an angle of 60 degrees in the printing medium feeding direction by the printing medium when the printing medium is printed, and further rotates at an angle of 180 degrees by a weight of the duplex guide after the duplex guide rotates at an angle of 110 degrees by the rib of the actuator separator when the jammed printing medium is removed.

Further, the actuator separator is spaced apart from the jam removing cam at a predetermined distance where the printing medium passes.

Further, the actuator separator and the jam removing cam project in the substantially same direction.

Further, the jam removing mechanism includes a second jam removing cam disposed on a third side of the jam removing shaft opposite to the another side to be spaced-apart from the jam removing cam by a second predetermined distance so that the printing medium passes between the two jam removing cams.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
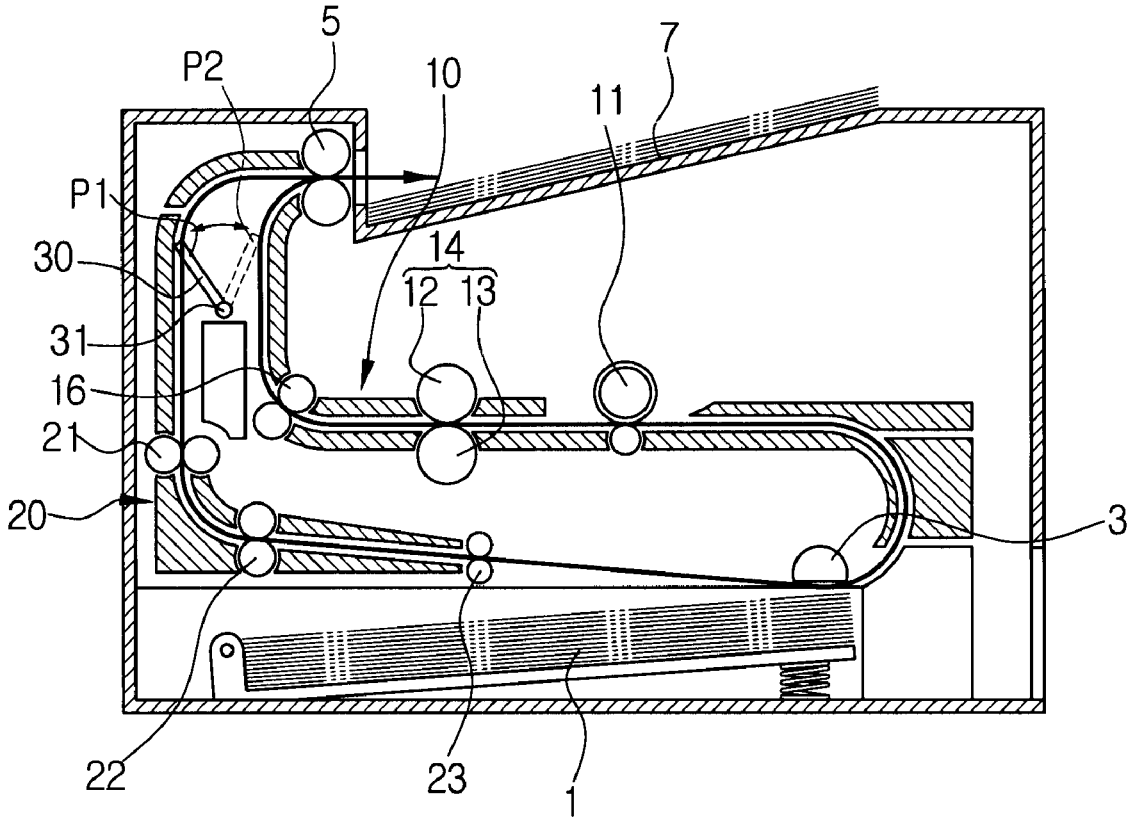
FIG. 1 (PRIOR ART)
FIG. 1 is a cross-sectional view showing a conventional duplex printer having an actuator.
Figure 2:
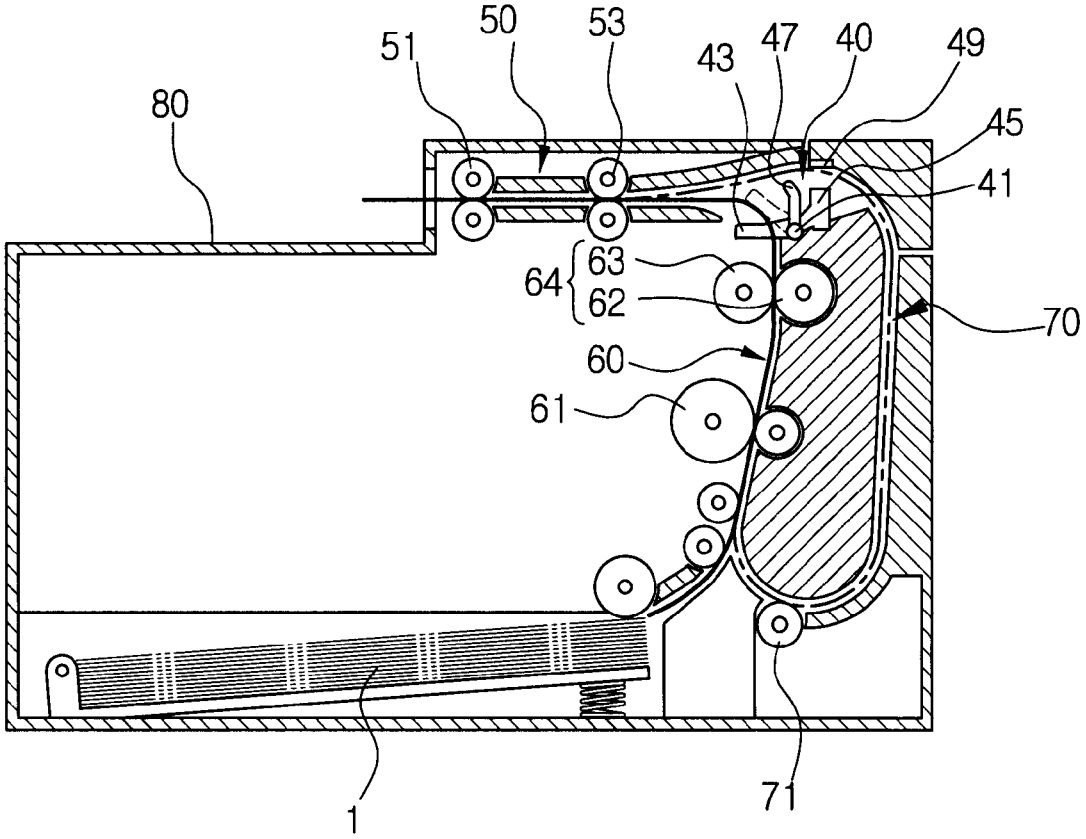
FIG.2 (PRIOR ART)
FIG. 2 is a cross-sectional view showing another type of the conventional duplex printer having another actuator.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Referring to FIGS. 3 through 7, a multi-function actuator 100 in accordance with an embodiment of the present invention includes a duplex guide 101, a sensor arm 106, and a jam removing mechanism having a jam removing shaft 121, an actuator separator 123, and a jam removing cam 125.

Figure 3:
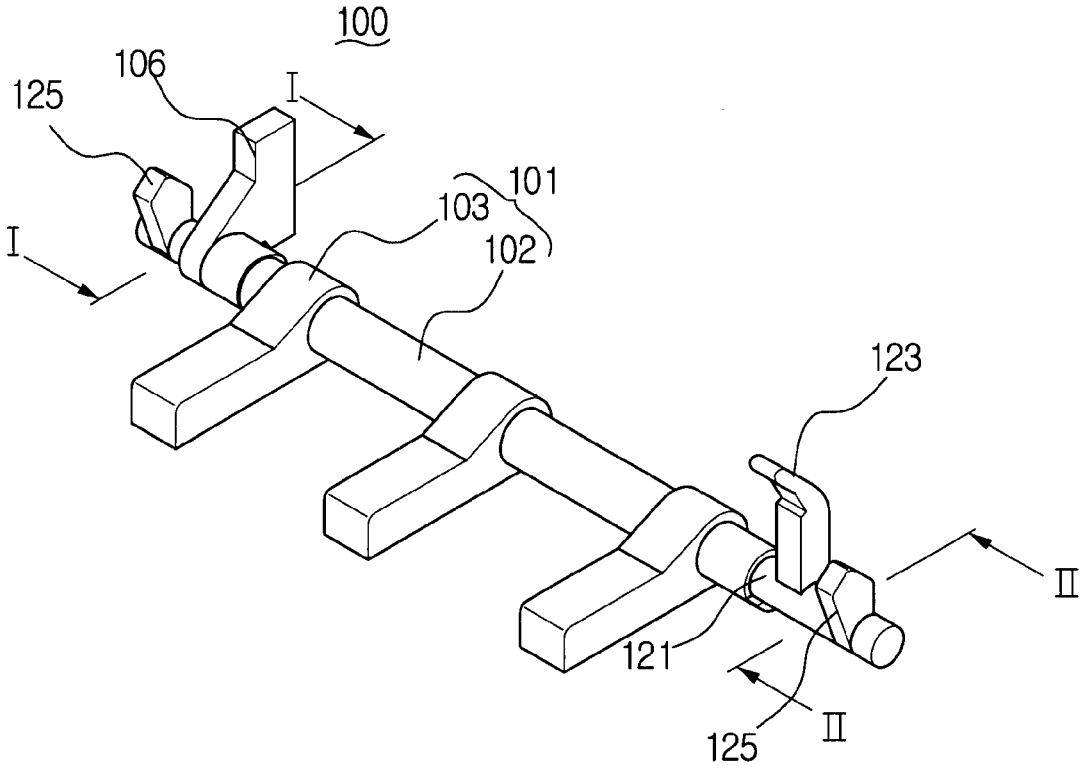
FIG. 3 is a perspective view showing a multi-function actuator according to an embodiment of the present invention.
Figure 6:
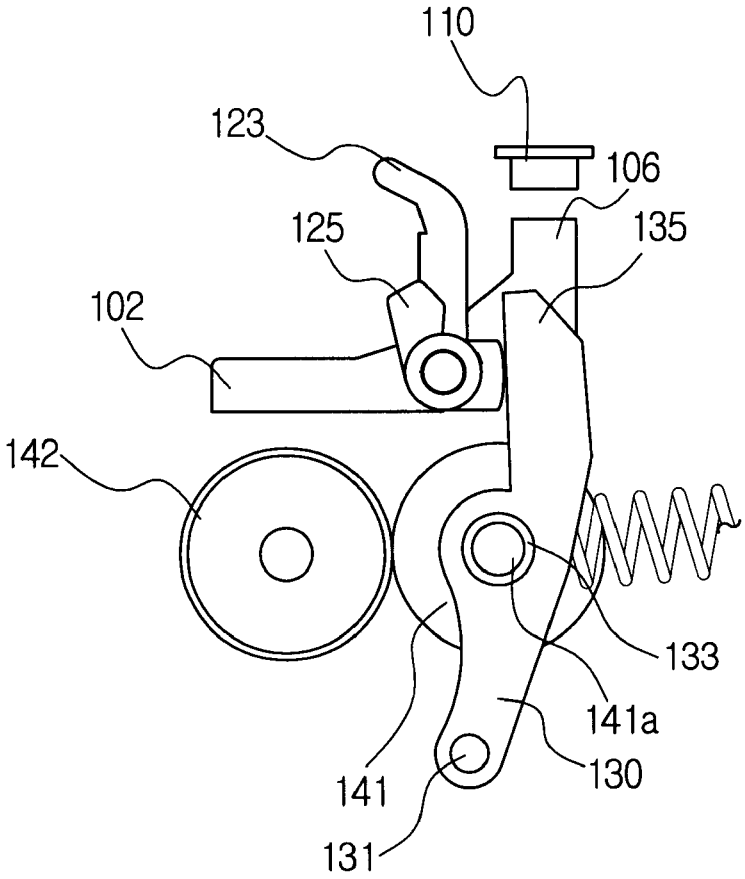
FIG. 6 is a schematic showing a jam removing mechanism of the multi-function actuator of FIG. 3.

The duplex guide 101 includes a hollow cylinder 102 and a plurality of guide pins 103 formed in a row on the hollow cylinder 102 at predetermined intervals and projecting in one direction from a side of the hollow cylinder 102 as shown in FIG. 3. The guide pins 103 have a square bar shape, a lower part formed such that a front end of a printing medium 1 can be easily guided into a discharge passage 160 of FIG. 7 when one side of the printing medium 1 is printed, and an upper part formed such that the printing medium 1 having the one side printed can be easily guided into a duplex printing passage 150 of FIG. 7 without being obstructed when the other side of the printing medium 1 is printed. As shown in FIG. 6, the hollow cylinder 102 of the duplex guide 101 is disposed above a pressure roller 141 of a fixing unit 143, and the guide pins 103 are disposed above a heat roller 142 of the fixed unit 143. Therefore, the duplex guide 101 is rotated upward about an axle of the hollow cylinder 102 by the printing medium 1 moving between the pressure roller 141 and the heat roller 142.

Figure 4:
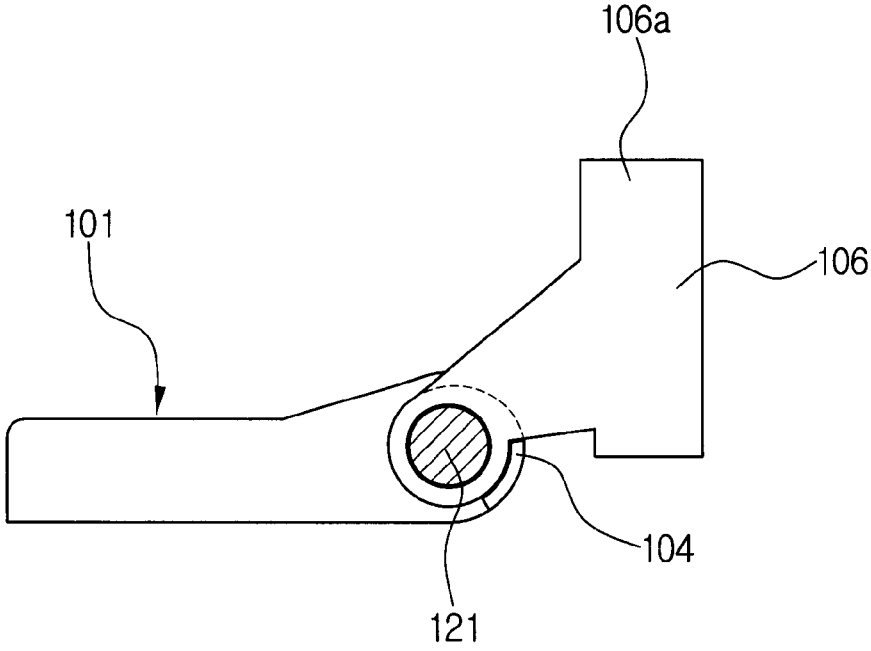
FIG. 4 is a cross-sectional view of the multi-function actuator taken along line I—I of FIG. 3.

In FIG. 4, the sensor arm 106 is disposed co-axially with the hollow cylinder 102 of the duplex guide 101 and eccentrically formed such that the sensor arm 106 always receives a force rotating about the hollow cylinder 102 downward by a weight of the sensor arm 10. Also, a low portion of the sensor arm 106 is supported by a supporting end 104 formed on the duplex guide 101 so that the guide pins 103 of the duplex guide 101 and the sensor arm 106 are at a first predetermined angle with respect to each other. Therefore, if the duplex guide 101 is rotated upward by the printing medium 1, the sensor arm 106 is rotated downward as much as the duplex guide 101 rotates.

Figure 8:
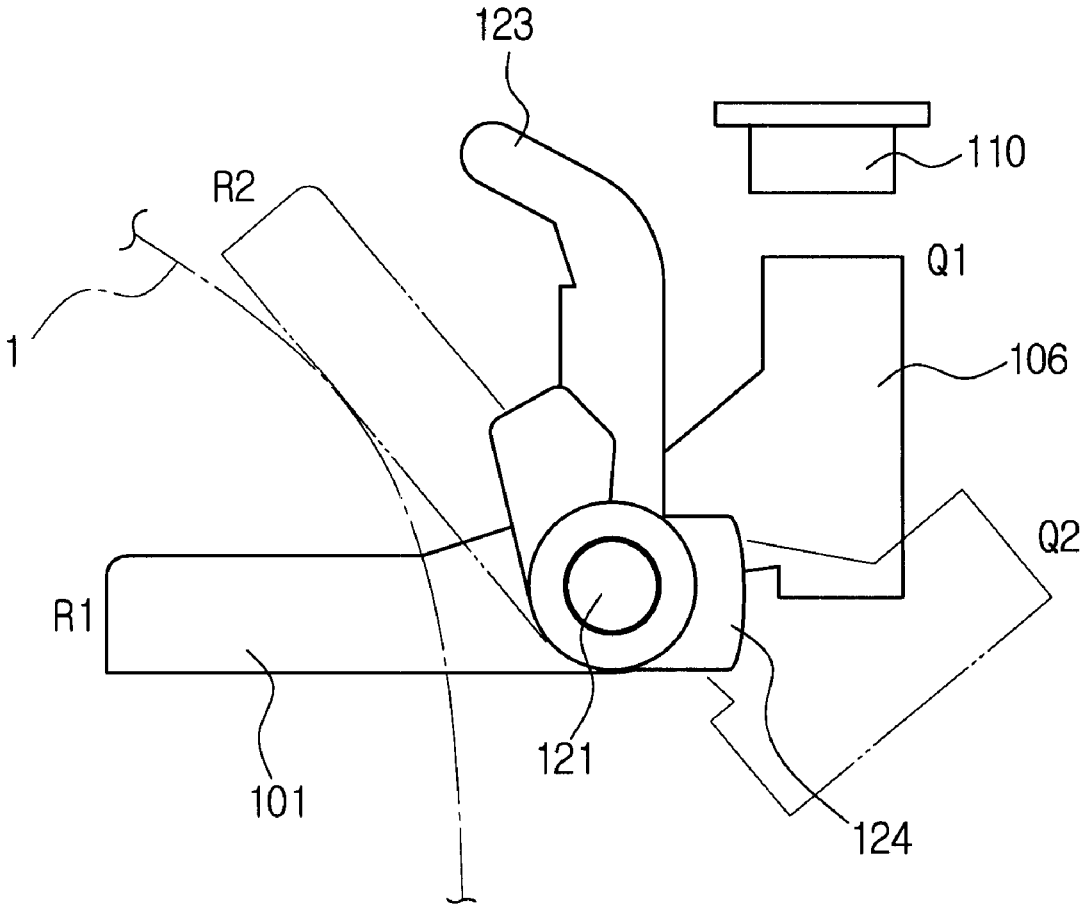
FIG. 8 is a schematic diagram showing that a duplex guide pin operates by a printing medium in the multi-function actuator of FIG. 3.

Also, when the guide pins 103 of the duplex guide 101 are disposed in a horizontal position R1 of FIG. 8, the duplex guide 101 and sensor arm 106 are balanced. Therefore, when each guide pin 103 of the duplex guide 101 is moved by the front end of the printing medium 1, the duplex guide 101 rotates in the clockwise with the sensor arm 106. The duplex guide 101 is returned to the horizontal position when the printing medium 1 is not in contact with the guide pin 103.

Figure 7:
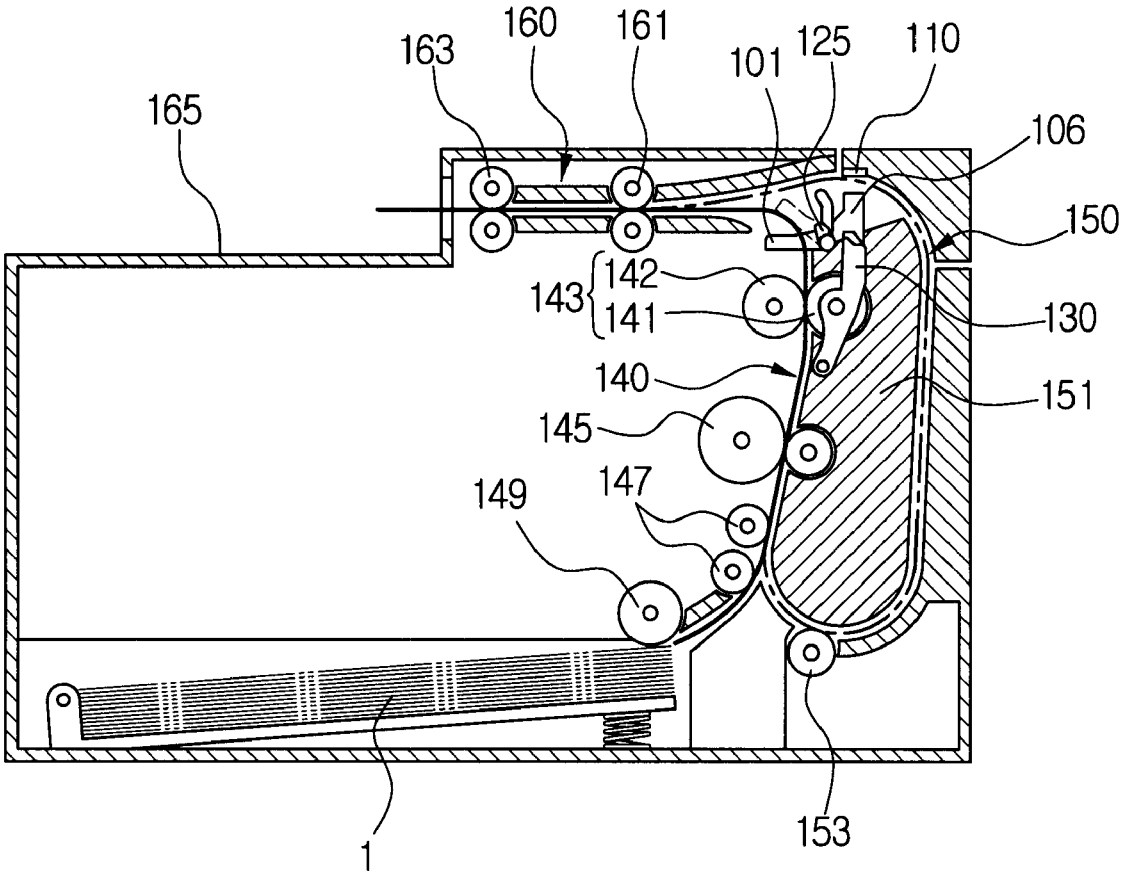
FIG. 7 is a cross-sectional view showing a duplex printer having the multi-function actuator of FIG. 3.

Also, a sensor 110 is disposed at a duplex printer frame 151 of FIG. 7 to sense an upper surface 106*a* of the sensor arm 106 when the duplex guide 101 is at the horizontal position.

The jam removing mechanism separates the pressure roller 141 from the heat roller 142 in order to remove a jammed printing medium 1 from the fixing unit 143 and includes a jam removing lever 130, the jam removing shaft 121, the actuator separator 123, and the jam removing cam 125 as shown in FIG. 6.

The jam removing lever 130 has one end 131 hinged to the duplex printer frame 151, at which the pressure roller 141 is disposed, and another end 135. The jam removing lever 130 has a penetrating hole 133 formed at a middle portion between the one end 131 and another end 135, and a rotation shaft 141*a* of the pressure roller 141 is movably inserted into the penetrating hole 133 of the jam removing lever 130. The jam removing lever 130 can be disposed at one side of the pressure roller 141, but the jam removing lever 130 may be disposed at each of both sides of the pressure roller 141.

The jam removing shaft 121 is inserted into the hollow cylinder 102 of the duplex guide 101, and both ends thereof are rotatable mounted on the duplex printer frame 151.

The actuator separator 123 is disposed on a portion of one side of the jam removing shaft 121, where there is no interference with the duplex guide 101, and therefore, if the actuator separator 123 rotates by a second predetermined angle, the jam removing shaft 121 is rotated as much as the actuator separator 123 is rotated.

Figure 5:
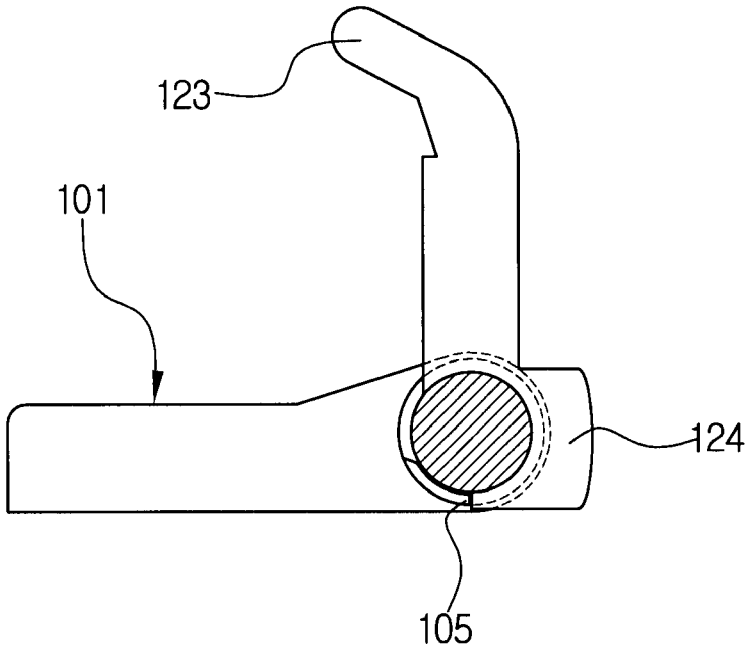
FIG. 5 is a cross-sectional view of the multi-function actuator taken along line II—II of FIG. 3.
Figure 9:
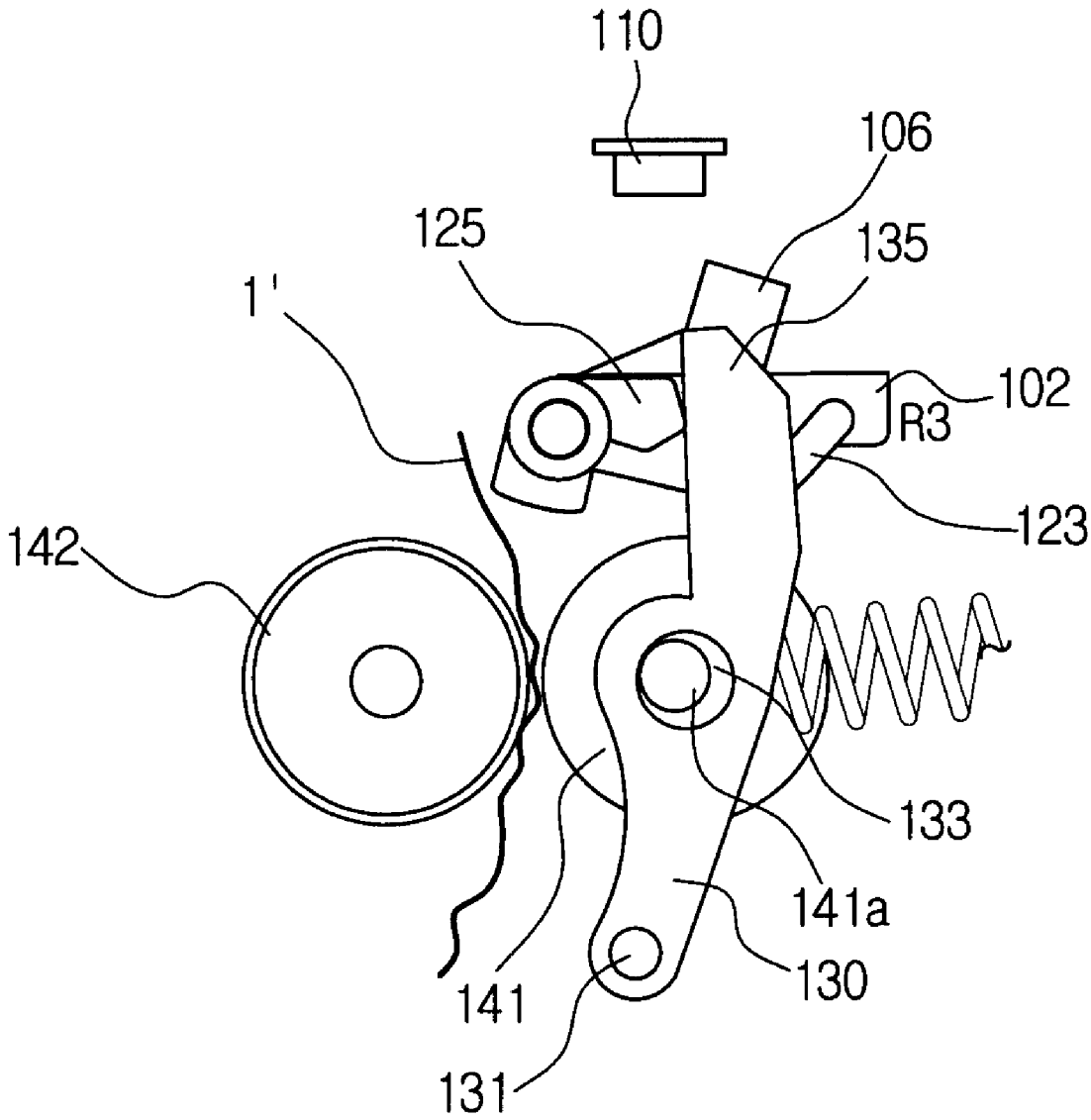
FIG. 9 is a schematic diagram showing a jammed printing medium and the jam removing mechanism of FIG. 3.

In FIGS. 3 and 5, a low part of the actuator separator 123 has a rib 124 formed on another portion of the jam removing shaft 121 to be in contact with an interfering portion 105 of the duplex guide 101. The rib 124 is formed such that, when the duplex guide 101 is in the horizontal position R1, the actuator separator 123 is almost in a vertical position, if the actuator separator 123 rotates in a clockwise direction by the second predetermined angle, the duplex guide 101 is rotated to about 180° from the horizontal position R1 by the weight of duplex guide 101 after being rotated to the second predetermined angle by the rib 124 as much as the actuator separator 123 is rotated. At this time, the actuator separator 123 is formed to rotate to about 110° from the horizontal position R1 so that the duplex guide 101 can further rotate by the weight thereof as shown in FIG. 9.

The jam removing cam 125 projects from a third portion of the jam removing shaft 121 in almost the same direction as the actuator separator 123 projects from the one portion of the jam removing shaft 121. There is no interference between the duplex guide 101 and the jam removing cam 125 or the actuator separator 123, except the interfering portion 105 of the duplex guide 101 and the rib 124 of the actuator separator 123. Accordingly, if the actuator separator 123 rotates, the jam removing cam 125 also rotates with the actuator separator 123 as much as the actuator separator 123 rotates.

Because a cam part of the jam removing cam 125 is formed to correspond to a distal end 135 of the jam removing lever 130, if the actuator separator 123 rotates by the predetermined angle, the jam removing cam 125 smoothly touches the another end 135 of the jam removing lever 130 and thus rotates the jam removing lever 130 by a third predetermined angle about a hinge of the one end 131. Accordingly, the pressure roller 141 is separated from the heat roller 142 by the jam removing lever 130 to provide a free space between the pressure roller 141 and the heat roller 142.

The jam removing cam 125 is formed to allow the jam removing lever 130 to make enough space to allow the jammed printing medium 1 to be easily removed between the pressure roller 141 and the heat roller 142.

Also, because the jam removing cam 125 is disposed to correspond to the jam removing lever 130, the jam removing cam 125 can be disposed at one side of the jam removing shaft 121. The jam removing mechanism may include a plurality of jam removing cams 125, and the jam removing cams 125 may be disposed at both sides of the jam removing shaft 121.

From now on, operations according to the embodiment of the present invention will be described referring to FIGS. 7 through 9.

When a printing operation of printing one side of the printing medium 1 is finished, duplex printing operations are performed next.

The printing medium 1 stacked in a paper cassette is moved into a development unit 145 by a feeding roller 149 and transporting rollers 147, and thus a printing image is transferred to the one side of the printing medium 1 by the development unit 145. Then, the printing medium 1 having the transferred printing image is passed through a fixing unit 143 and thus the transferred printing image is fixed on the one side of the printing medium 1 by the pressure roller 141 and the heat roller 142 thereof.

After passing through out the fixing unit 143, the printing medium 1 strikes and rotates the duplex guide 101 to a guiding position Rd. By the front end thereof, and the printing medium 1 is moved to the discharge passage 160. And then, when the printing medium 1 is not in contact with the duplex guide 101, the duplex guide 101 is returned to the horizontal position R1 by the weight thereof. The printing medium 1 moving into the discharge passage 160 is discharged into a discharge tray 165.

When both sides of the printing medium 1 are printed, the next duplex printing operations are as follows.

When the printing medium 1, which has been printed on the one side thereof according to the previous printing operation described above, is moved through the discharge passage 160, the duplex guide 101 is returned to the horizontal position R1 so that the sensor arm 106 is located at a position Q1 Corresponding to the sensor 110.

If the sensor 110 senses the sensor arm 106, the sensor 110 sends a signal to a duplex printer controller (not shown). Then the discharge roller 161 is rotated in a reverse direction by the duplex printer controller.

If the discharge roller 161 rotates in the reverse direction, the printing medium 1 is moved in the opposite direction opposite to the discharge direction. At this time, because the duplex guide 101 is at the horizontal position R1, the printing medium 1 is moved over the duplex guide 101 and into the duplex printing passage 150.

The printing medium 1 is moved into the development unit 145 by transporting rollers 153,147. At this time, the other side of the printing medium 1 faces upward, and then is printed by the development unit 145 and the fixing unit 143.

The printing medium 1 printed on both sides thereof rotates the duplex guide 101 upward. Next, the printing medium 1 is moved into the discharge passage 160 and discharged to the discharge tray 165 by the discharge rollers 161and 163.

Finally, the operation of removing a jammed printing medium 1 jammed in the fixing unit 143 as shown in FIG. 9 is described as follows.

When the jammed printing medium 1 is jammed in the fixing unit 143, a user rotates the actuator separator 123 by the second predetermined angle. Here, the second predetermined angle is generally set to about 110°.

If the actuator separator 123 rotates, the jam removing cam 125 is rotated by the jam removing shaft 121 as much as the actuator separator 123 rotates. The jam removing shaft 121 and the jam removing cam 125 are integrally formed with the actuator separator 123.

And then, the jam removing lever 130 is rotated at the third predetermined angle by the jam removing cam 125 contacting the another end 135 of the jam removing lever 130. If the jam removing lever 130 rotates by the third predetermined angle, the rotation shaft 141a of the pressure roller 141, which is inserted in the penetrating hole 133 of the jam removing lever 130, rotates by the same third predetermined angle as the jam removing lever 130 about the hinge of the one end 131 of the jam removing lever 130 at the same time. Accordingly, the pressure roller 141 is separated from the heat roller 142.

Therefore, the jammed printing medium 1 jammed between the pressure roller 141 and the heat roller 142, can be easily removed.

Also, if the actuator separator 123 rotates by about 110° from the vertical position, the duplex guide 101 rotates to about 110° by the rib 124 of the actuator separator 123 and the interfering portion 105 of the duplex guide 101 from the horizontal position R1 and then further rotates to 180° from the horizontal position R1 to be positioned at a second horizontal position Re by the weight of the duplex guide 101. Because the duplex guide 101 is at the second horizontal position Re, the jammed printing medium 1, not only in the fixing unit 143 but also in the discharge passage 160, can be easily removed.

According to the multi-function actuator constructed in accordance with the embodiment of the present invention, one side or both sides of the printing medium 1 can be easily printed, and the jammed printing medium 1 can be easily removed, because the pressure roller 141 is separated from the heat roller 142 and the discharge passage is not blocked by the duplex guide 101. In other words, one actuator has multi functions, such as printing on one side of the printing medium 1, printing on both sides of the printing medium 1, and removing the jammed printing medium 1.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A multi-function actuator of a duplex printer having a heat roller and a pressure roller having a rotation shaft rotatable mounted in a duplex printing frame, comprising:

a duplex guide rotatable disposed above the pressure roller and on the duplex printer frame to move between a first position and a second position, including a hollow cylinder with a supporting end and a plurality of guide pins formed in a row at one side of the hollow cylinder and above the heat roller to guide and rotate from the first position to the second position by a printing medium passing through a passage;

a jam removing mechanism rotatable disposed inside of the hollow cylinder, separating the pressure roller from the heat roller when the printing medium which becomes jammed, is removed;

a sensor arm disposed co-axially with the duplex guide to rotate by a weight of the sensor arm supported at a lower portion thereof by the supporting end of the duplex guide; and a sensor disposed at the duplex printer frame, the sensor being operated by] to sense the sensor arm in response to rotation of the duplex guide.

2. The multi-function actuator of claim 1, wherein the jam removing mechanism comprises:

a jam removing lever rotatable disposed at the duplex printer frame and on a side of the pressure roller, having a first end, a second end, and a penetrating hole formed between the first end and the second end, the penetrating hole receiving the rotation shaft of the pressure roller;

a jam removing shaft rotatable inserted inside of the hollow cylinder and rotatable disposed at the duplex printer frame;

an actuator separator attached to one side of the jam removing shaft to rotate the jam removing shaft by a predetermined angle, thereby removing the printing medium jammed between the pressure roller and the heat roller;

a jam removing cam disposed at another side of the jam removing shaft to contact the second end of the jam removing lever rotating about the first end, and formed such that when the actuator separator rotates by the predetermined angle in a direction, the jam removing lever rotates in the direction to the predetermined angle by the jam removing cam to separate the pressure roller from the heat roller.

3. The multi-function actuator of claim 2, wherein the actuator separator comprises a rib rotating the duplex guide from the first position to the second position when the actuator separator rotates to allow the jammed printing medium to be removed.

4. The multi-function actuator of claim 3, wherein the duplex guide rotates from the first position toward the second position by an angle of 60° in a printing medium feeding direction by the printing medium when the printing medium is printed, and the duplex guide further rotates to an angle of 180° by a weight of the duplex guide after rotating by an angle of 110° by the rib of the actuator separator when the jammed printing material is removed.

5. The multi-function actuator of claim 2, wherein the actuator separator is spaced apart from the jam removing cam at a predetermined distance, and the printing medium passes between the actuator separator and the jam removing cam.

6. The multi-function actuator of claim 2, wherein the actuator separator and the jam removing cam are projected in a substantially same direction from the jam removing shaft.

7. The multi-function actuator of claim 2, wherein the jam removing mechanism further comprises a second jam removing cam which is spaced-apart from the jam removing cam by a distance, and the printing medium passes between the jam removing cam and the second jam removing cam.

8. A multi-function actuator in a duplex printer, comprising:

a frame having a printing passage and a duplex passage;

a fixing unit disposed at the printing passage and having a heat roller and a pressure roller disposed to contact the heat roller;

a duplex guide disposed in the printing passage and having a hollow cylinder and a guide pin formed on the hollow cylinder, moving in a first position blocking the printing passage and opening the duplex passage and in a second position opening the printing passage; and a jam removing mechanism having a shaft rotatable inserted into the hollow cylinder, a cam formed on the shaft, and a lever separating the pressure roller from the heat roller in response to rotation of the cam of the shaft.

9. The actuator of claim 8, wherein the guide pin moves to the first position by a weight of the guide pin and to the second position by a printing medium passing through the printing passage.

10. The actuator of claim 8, wherein the guide pin moves from the second position to the first position by the weight of the guide pin when the printing medium does not push the guide pin up to the second position, the guide pin guiding the printing medium into the duplex passage when disposed in the first position.

11. The actuator of claim 8, wherein the jam removing mechanism comprises:

a separator formed on the shaft of the jam removing mechanism to control the shaft to rotate;

a rib formed on the shaft to rotate by the separator; and an interfering portion formed on the hollow cylinder of the duplex guide to contact the rib when the guide pin is in the first position, the guide pin moving from the first position to the second position when the interfering portion rotates by the rib.

12. The actuator of claim 11, wherein the interfering portion neither contacts nor moves the rib when the guide pin rotates from the first position to the second position by the printing medium.

13. The actuator of claim 11, wherein the separator has a first angle with the rib around the shaft and a second angle with the guide pin around the hollow cylinder, and the rib is disposed opposite to the guide pin with respect to the separator.

14. The actuator of claim 13, wherein the first angle and the second angle are about 90 degrees, and the guide pin and the rib are parallel to each other.

15. The actuator of claim 11, wherein the separator and the cam are spaced apart from each other along the shaft by a predetermined distance.

16. The actuator of claim 11, wherein the separator and the cam are disposed opposite to each other along the shaft with respect to the guide pin.

17. The actuator of claim 11, wherein the separator and the cam project from the shaft in the substantially same direction.

18. The actuator of claim 17, wherein the printing passage is formed between the separator and the cam.

19. The actuator of claim 11, further comprising:

a sensor arm having a second hollow cylinder disposed coaxial with the hollow cylinder to rotate around the shaft by a weight of the sensor arm when disposed in a top position;

a support end formed on the hollow cylinder of the duplex guide to contact and prevent the sensor arm from rotating by the weight of the sensor arm when the guide pin is in the first position; and a sensor disposed on the frame to detect the sensor arm when the sensor arm is in the top position.

20. The actuator of claim 19, wherein the sensor arm projects from the second hollow cylinder in a direction with an angle greater than about 90 degrees with respect to the guide pin which is in the first position.

21. The actuator of claim 19, wherein the sensor arm is disposed opposite to the guide pin with respect to a vertical line passing through a center of the shaft in cross-section.

22. The actuator of claim 19, wherein the guide pin allow the sensor arm to rotate by the weight of the sensor arm when the guide pin rotates from the first position to the second position.

23. The actuator of claim 22, wherein the support end of the duplex guide does not contact the sensor arm when the guide pin moves from the first position to the second position.

24. The actuator of claim 19, wherein the support end of the duplex guide becomes in contact with the sensor arm to control the sensor arm to move to the top position when the guide pin moves to the first position.

25. The actuator of claim 24, wherein the sensor arm does not rotate by the weight of the sensor arm when the guide pin is in the first position by the weight of the guide pin.

26. The actuator of claim 8, wherein the lever comprises one end rotatable coupled to the frame, another end contacting the cam, and a hole formed between the one end and the another end, and the pressure roller comprises an axle movably inserted into the hole, the axle moving by the lever to separate the pressure roller from the heat roller when the lever rotates about the one end by the cam in a separating direction.

27. The actuator of claim 26, wherein the hole of the lever has a diameter greater than that of the axle of the pressure roller.

28. The actuator of claim 26, wherein the fixing unit comprises a spring biasing the pressure roller against the heat roller, and the pressure roller moves against the heat roller when the lever rotates in a releasing direction opposite to the separating direction.

29. The actuator of claim 26, wherein the jam removing mechanism comprises a rib formed on the shaft to control the guide pin to move between the first position and a third position opposite to the first position with respect to the shaft, and the printing passage is not blocked by the guide pin when the guide pin moves to the third position.

30. The actuator of claim 8, wherein the jam removing mechanism comprises an additional cam formed on the shaft opposite to the cam along the shaft with respect to the guide pin, and the printing passage is disposed between the cam and the additional cam.

31. A multi-function actuator in a duplex printer, comprising:

a duplex printer frame having a printing passage and a duplex passage;

a fixing unit disposed in the printing passage and having heat and pressure rollers rotatable mounted on the duplex printer frame;

a sensor arm rotatable mounted on the duplex printer frame and rotated by a weight of the sensor arm;

a sensor disposed on the duplex printer frame corresponding to the sensor arm;

a duplex guide including a hollow cylinder rotatable mounted on the duplex printer frame, a guide pin formed at a first side of the hollow cylinder to rotate between a first position allowing a printing medium to pass through the printing passage and a second position blocking the printing passage and allowing the printing medium to pass through the duplex passage, and a support end formed on a second side of the hollow cylinder to contact the sensor arm to prevent the sensor arm from rotating by the weight of the sensor arm when the guide pin is in the first position; and a jam removing mechanism having a shaft rotatable disposed inside of the hollow cylinder and mounted on the duplex printer frame, end portions of the shaft protruding from respective ends of the hollow cylinder, a separator formed on the shaft to rotate the shaft supporting the sensor arm, a cam formed on the shaft, and a lever disposed adjacent to the cam to separate the pressure roller from the heat roller in response to rotation of the cam of the shaft.

32. The actuator of claim 31, wherein the duplex guide comprises an interfering portion formed on a third side of the hollow cylinder, and the jam removing mechanism comprises a rib formed on one of the end portions of the shaft to contact the interfering portion of the hollow cylinder when the shaft rotates by the separator.

33. The actuator of claim 32, wherein the guide pin of the duplex guide rotates from the first position to the second position not to block the printing passage when the rib of the jam removing mechanism rotates by the separator to contact the interfering portion of the duplex guide.

34. The actuator of claim 32, wherein the guide pin is in the first position in a horizontal direction and moves to the second position having an angle of about 60 degrees with respect to the horizontal direction by the printing medium passing through the printing passage.

35. The actuator of claim 34, wherein the guide pin moves to a third position having an angle of about 110 degrees with respect to the first position by the rib of the shaft of the jam removing mechanism.

36. The actuator of claim 35, wherein the guide pin moves from the third position to a fourth position opposite to the first position about the hollow cylinder by a weight of the guide pin.

37. The actuator of claim 36, wherein the guide pin moves from the fourth position to the first position by a contact between the rib and the interfering portion and the weight of the guide pin in order.

38. The actuator of claim 31, wherein the sensor arm is disposed co-axially with the duplex guide to rotate by the weight of the sensor arm and includes a low part supported by the supporting end of the duplex guide when the guide pin is in the first position.

39. The actuator of claim 31, wherein the duplex guide comprises a plurality of additional guide pins formed on the same first side of the hollow cylinder, and the guide pin and the additional guide pins are arranged in a row above the fixing unit.

40. The actuator of claim 31, wherein the separator is formed on one of the end portions of the shaft, and the cam is formed on another one of the end portions, and the hollow cylinder is disposed between the separator and the cam.

41. The actuator of claim 40, wherein the separator is disposed closer to the hollow cylinder than the cam.

42. The actuator of claim 40, wherein the sensor arm is disposed closer to the hollow cylinder than the cam.

43. The actuator of claim 31, wherein the jam removing mechanism comprises:

a second cam formed on one of the end portions of the shaft opposite to the cam formed on another one of the end portions, and the hollow cylinder is disposed between the cam and the second cam.

44. The actuator of claim 43, wherein the jam removing mechanism comprises:

a second lever disposed adjacent to the second cam to separate the pressure roller from the heat roller.

45. The actuator of claim 44, wherein the sensor arm is disposed closer to the hollow cylinder than the cam and the second cam.

46. The actuator of claim 31, wherein the jam removing mechanism provides a space between the heat roller and the pressure roller to allow a jammed printing medium, disposed in the printing passage, to be removed in response to rotation of the cam formed on the shaft.

47. A method in a multi-function actuator of a duplex printer having a printing passage, heat and pressure rollers disposed in the printing passage, a duplex guide having a hollow cylinder and a plurality of guide pins formed on the hollow cylinder to move between a first position blocking the printing passage and a second position opening the printing passage, a jam removing mechanism having a shaft inserted into the hollow cylinder, a separator formed on the shaft to rotate the shaft, a cam formed on the shaft, and a lever disposed adjacent to the cam and coupled to the pressure roller, the method comprising:

rotating the cam in response to rotation of the separator;

separating the pressure from the heat roller in response to rotation of the cam; and rotating the guide pin from the first position to the second position in response to rotation of the separator.

48. The method of claim 47, wherein the duplex printer comprises a sensor arm coaxial coupled to the hollow cylinder and being rotated by a weight of the sensor arm, the method comprising:

preventing the sensor arm from rotating by the weight of the sensor arm when the guide pin is in the first position; and allowing the sensor arm to rotate by the weight of the sensor arm when the guide pin moves to the second position.

49. The method of claim 47, wherein the rotating of the guide pin comprises:

rotating the guide pin by the rotating of the separator and a weight of the guide pin when the lever separates the pressure roller from the heat roller or when the lever allows the pressure roller to contact the heat roller.

* * * * *

UNITED STATES PATENT AND TRADEMARK OFFICE

CERTIFICATE OF CORRECTION

PATENT NO. : 6,621,997 B2
DATED : September 16, 2003
INVENTOR(S) : Kyung-shig Chung It is certified that error appears in the above-identified patent and that said Letters Patent is hereby corrected as shown below:

Title page,
Item [57], ABSTRACT,
Lines 6 and 9, please change “rotatable” to -- rotatably --.
Line 12, please change “with” to -- sensor --.

Column 8,
Lines 31 ,32, 40, 53, 59 and 60, please change “rotatable” to -- rotatably --.

Column 9,
Line 47, please change “rotatable” to -- rotatably --.

Column 10,
Line 31, please change “coaxial” to -- coaxially --.
Line 63, please change “rotatable” to -- rotatably --.

Column 11,
Lines 25, 27, 31 and 42, please change “rotatable” to -- rotatably --.

Column 12,
Line 66, please change “coaxial” to -- coaxially --.

Signed and Sealed this

Fourth Day of May, 2004

JON W. DUDAS
*Acting Director of the United States Patent and Trademark Office*